US010525740B2

(12) United States Patent
Iwanami

(10) Patent No.: US 10,525,740 B2
(45) Date of Patent: Jan. 7, 2020

(54) ROLL MEDIUM TRANSPORT APPARATUS, PRINTING APPARATUS, AND SETTING METHOD FOR ROLL MEDIUM

(71) Applicant: SEIKO EPSON CORPORATION, Tokyo (JP)

(72) Inventor: Shinichi Iwanami, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 141 days.

(21) Appl. No.: 15/914,463

(22) Filed: Mar. 7, 2018

(65) Prior Publication Data

US 2018/0264855 A1 Sep. 20, 2018

(30) Foreign Application Priority Data

Mar. 16, 2017 (JP) ..... 2017-050912

(51) Int. Cl.

| | |
|---|---|
| ***B41J 11/00*** | (2006.01) |
| ***B41J 15/04*** | (2006.01) |
| ***B65H 23/032*** | (2006.01) |
| ***B65H 18/14*** | (2006.01) |

(52) U.S. Cl.

CPC ..... *B41J 11/0095* (2013.01); *B41J 15/04* (2013.01); *B65H 18/145* (2013.01); *B65H 23/032* (2013.01); *B65H 2553/41* (2013.01); *B65H 2553/46* (2013.01)

(58) Field of Classification Search

CPC ..... B41J 11/0095; B41J 15/04; B65H 18/145; B65H 23/032; B65H 2553/41; B65H 2553/46

See application file for complete search history.

(56) References Cited

U.S. PATENT DOCUMENTS

| | | | | |
|---|---|---|---|---|
| 3,261,284 | A * | 7/1966 | Lynott | B41J 2/41 101/114 |
| 3,633,835 | A * | 1/1972 | Beers | B65H 63/0324 242/485.2 |
| 4,529,186 | A * | 7/1985 | Gratsch | B65H 45/103 270/30.03 |
| 4,736,900 | A * | 4/1988 | Okamura | B65H 23/1806 242/334.2 |
| 4,753,702 | A * | 6/1988 | Kurihara | B44C 1/28 156/230 |
| 5,450,168 | A * | 9/1995 | Utsumi | G03G 15/18 399/151 |
| 5,855,336 | A * | 1/1999 | Inoue | B65H 19/22 242/348.4 |

(Continued)

FOREIGN PATENT DOCUMENTS

| | | | |
|---|---|---|---|
| JP | 08-108588 | A | 4/1996 |
| JP | 2013-233802 | A | 11/2013 |

*Primary Examiner* — Michael E Gallion
(74) *Attorney, Agent, or Firm* — Workman Nydegger

(57) ABSTRACT

A roll medium transport apparatus includes a feed roll medium support unit that feeds a roll medium, a takeup roll medium support unit that winds up the roll medium that has been fed, a position acquiring unit that acquires a position of a side end portion of the roll medium that is to be fed, a radiating unit capable of radiating light with a position of the side end portion being used as a reference point. The radiating unit is held by the feed roll medium support unit and allows the light to be radiated to a takeup roll that winds up the roll medium.

7 Claims, 5 Drawing Sheets

(56) References Cited

U.S. PATENT DOCUMENTS

| | | | | |
|---|---|---|---|---|
| 6,000,871 | A * | 12/1999 | Fisher, Sr. | B41J 13/103 271/258.01 |
| 2013/0300794 | A1* | 11/2013 | Leighton | B41J 11/0005 347/16 |
| 2016/0214402 | A1* | 7/2016 | Nakagawa | B41J 11/002 |
| 2019/0092052 | A1* | 3/2019 | Yoshida | B41J 11/0025 |

* cited by examiner

ROLL MEDIUM TRANSPORT APPARATUS, PRINTING APPARATUS, AND SETTING METHOD FOR ROLL MEDIUM

BACKGROUND

1. Technical Field

The present invention relates to a roll medium transport apparatus, a printing apparatus, and a setting method for a roll medium.

2. Related Art

An ink jet print apparatus that includes a wind-out unit that feeds a print medium and a takeup unit that winds up the print medium has been known (see, e.g., JP-A-8-108588).

If the print medium from the wind-out unit is set onto the takeup unit so that the print medium on the takeup unit is oblique to the print medium wound on the wind-out unit, the print medium will be wound up in a misaligned state. Therefore, it is necessary to set the print medium so that the print medium on the wind-out unit and the print medium to be wound on the takeup unit are parallel. This requires a high level of technique and poses a problem of taking a relatively long time to set the print medium in parallel.

SUMMARY

An advantage of some aspects of the invention is that a roll medium transport apparatus, a printing apparatus, and a setting method for a roll medium as described below are provided.

A first aspect of the invention provides a roll medium transport apparatus includes a feed roll medium support unit that feeds a roll medium, a takeup roll medium support unit that winds up the roll medium that has been fed, a position acquiring unit that acquires a position of a side end portion of the roll medium that is to be fed; and a radiating unit capable of radiating light with a position of the side end portion being used as a reference point. The radiating unit is held by the feed roll medium support unit and allows the light to be radiated to a takeup roll that winds up the roll medium.

According to this aspect of the invention, since light radiated from the position as the reference point set on the side end portion of the roll medium in the feed roll medium support unit irradiates the takeup roll of the takeup roll medium support unit and provides a marking of light on the takeup roll, the roll medium can be set in alignment with the marking of light on the takeup roll. Therefore, the roll medium can be easily set in parallel and the operation of setting the roll medium can be easily carried out.

In the foregoing roll medium transport apparatus of the invention, the radiating unit may move in association with movement of the position acquiring unit.

According to this embodiment, since the radiating unit moves in association with movement of the position acquiring unit, the operating efficiency can be increased.

In another embodiment of the foregoing roll medium transport apparatus of the invention, the feed roll medium support unit may be disposed above the takeup roll medium support unit in terms of a vertical direction.

According to this embodiment, since light is radiated from the feed roll medium support unit disposed at a relatively high position in the vertical direction downward to the takeup roll medium support unit, a user can easily recognize the position of light on the takeup roll of the takeup roll medium support unit, so that the ease of operation can be further improved.

In still another embodiment of the roll medium transport apparatus of the invention, the roll medium transport apparatus may include a reflector member that reflects light radiated from the radiating unit.

According to this embodiment, for example, even in the case where the feed roll medium support unit is disposed at a lower position than the takeup roll medium support unit, light reflected from the reflector member can strike an upper portion of the takeup roll of the takeup roll medium support unit, so that the ease of operation can be improved.

In a further embodiment of the roll medium transport apparatus of the invention, the roll medium transport apparatus may further include a light scatterer that causes light reflected from the reflector member to scatter in a linear form when the light irradiates the takeup roll of the takeup roll medium support unit.

According to this embodiment, since the takeup roll is irradiated with a linear form of light, the roll medium can be easily set in alignment with the linear light.

A second aspect of the invention provides a printing apparatus that includes a feed roll medium support unit that feeds a roll medium, a takeup roll medium support unit that winds up the roll medium that has been fed, a position acquiring unit that acquires a position of a side end portion of the roll medium that is to be fed, and a radiating unit capable of radiating light with a position of the side end portion being used as a reference point. The takeup roll medium support unit includes a takeup roll that winds up the roll medium and the takeup roll receives light that the radiating unit radiates.

According to this aspect of the invention, since light radiated from the position as the reference point set on the side end portion of the roll medium in the feed roll medium support unit irradiates the takeup roll of the takeup roll medium support unit and provides a marking of light on the takeup roll, the roll medium can be set in alignment with the marking of light on the takeup roll. Therefore, the roll medium can be easily set in parallel and the operation of setting the roll medium can be easily carried out.

A third aspect of the invention provides a setting method for a roll medium in a roll medium transport apparatus that includes a feed roll medium support unit that feeds a roll medium, a takeup roll medium support unit that winds up the roll medium that has been fed, a position acquiring unit that acquires a position of a side end portion of the roll medium that is to be fed, and a radiating unit capable of radiating light with a position of the side end portion being used as a reference point. The setting method includes setting the roll medium in alignment with light radiated on a takeup roll of the takeup roll medium support unit.

According to this aspect of the invention, since light radiated from the position as the reference point set on the side end portion of the roll medium in the feed roll medium support unit irradiates the takeup roll of the takeup roll medium support unit and provides a marking of light on the takeup roll, the roll medium can be set in alignment with the marking of light on the takeup roll. Therefore, the roll medium can be easily set in parallel and the operation of setting the roll medium can be easily carried out.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
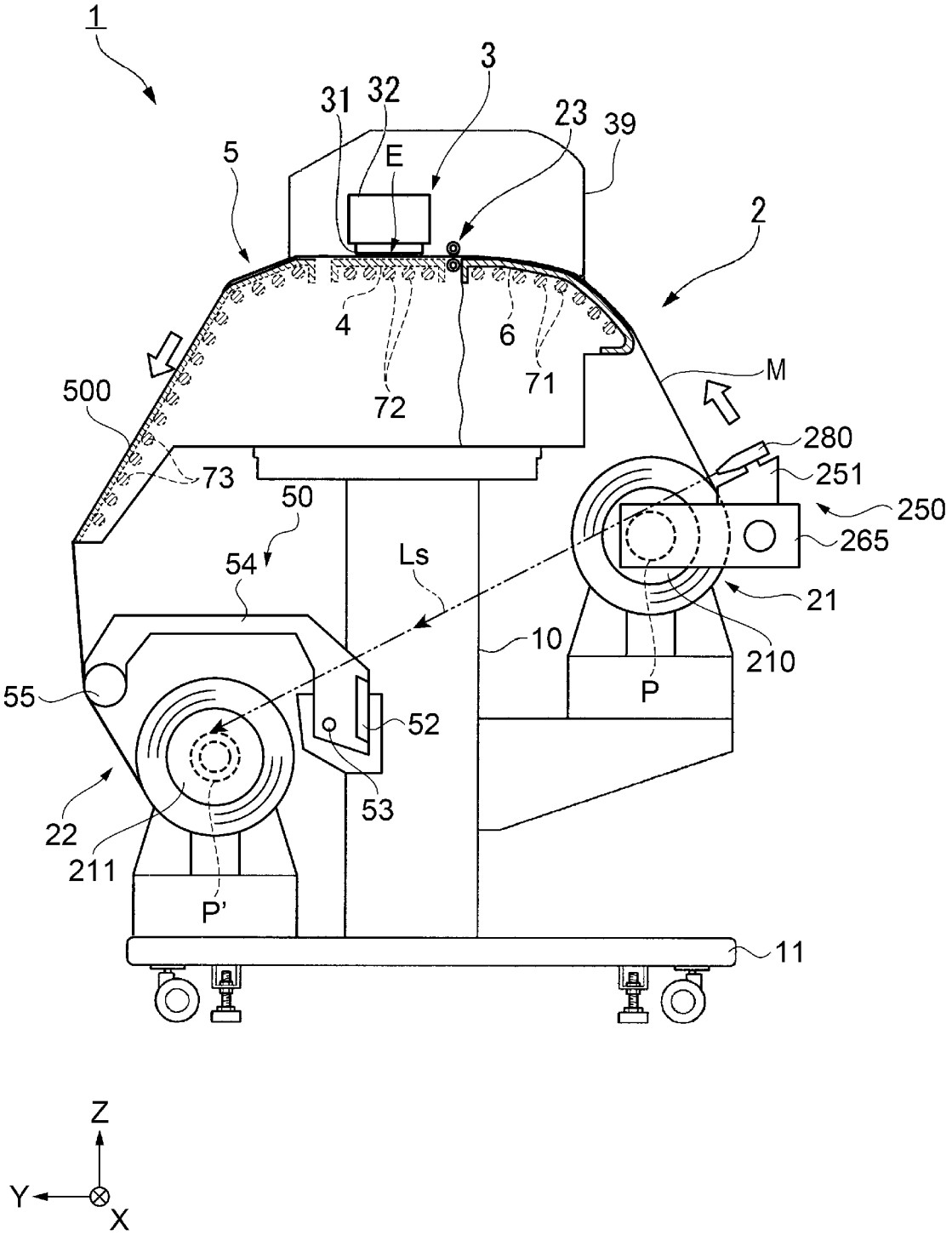
FIG. 1 is a schematic diagram illustrating a configuration of a printing apparatus according to a first exemplary embodiment of the invention.

First and second exemplary embodiments of the invention will be described hereinafter with reference to the drawings. In the drawings referred to below, the size proportions of various members and the like depicted are different from the actual size proportions thereof so that the members and the like have recognizable sizes in the drawings.

First Exemplary Embodiment

First, a configuration of a printing apparatus will be described. The printing apparatus is, for example, an ink jet type printer. The exemplary embodiment will be described in conjunction with a large format printer (LFP) that handles a relatively large medium as an example of the printing apparatus.

FIG. 1 is a schematic diagram (partly a side sectional view) illustrating a configuration of a printing apparatus. As illustrated in FIG. 1, a printing apparatus 1 includes a roll medium transport apparatus 2 as a transport unit that transports a roll medium M (hereinafter, referred to as medium M) by a roll-to-roll method, a printer unit 3 that records (prints) graphics, characters, etc. on the medium M by discharging (ejecting) ink (an example of a liquid) in the form of droplets to the medium M, a transport guiding unit 5 provided with a transport surface on which the medium M is transported, and a platen 4 disposed at a position that faces the printer unit 3. The printing apparatus 1 further includes a tension adjustment unit 50 capable of giving tension to the medium M by contacting the medium M. These components are supported on a body frame 10 that is disposed in a substantially vertical direction. The body frame 10 is connected to a base unit 11 that supports the body frame 10.

The roll medium transport apparatus 2 transports the medium M in a transport direction (indicated by blank arrows in FIG. 1). The roll medium transport apparatus 2 of this exemplary embodiment includes a feed roll medium support unit 21 (roll unit) that feeds the medium M in the transport direction from a rolled state, a takeup roll medium support unit 22 (reel unit) that winds up the medium M that has been fed, etc. The roll medium transport apparatus 2 further includes a transport roller pair 23 that transports the medium M on a transport path between the feed roll medium support unit 21 and the takeup roll medium support unit 22.

Details of the configuration of the roll medium transport apparatus 2 will be described later.

The printer unit 3 includes a droplet discharge head (ink jet head) 31 capable of discharging ink as droplets to the medium M and a carriage 32 on which the droplet discharge head 31 is mounted and which is capable of moving back and forth in width directions of the medium M (X-axis directions). The printing apparatus 1 further includes a casing 39 in which the droplet discharge head 31 and the carriage 32 are disposed.

The drive method for the droplet discharge head 31 is not particularly limited. For example, a pressurizer that uses vertical vibration type piezoelectric elements may be adopted, or bending deformation type piezoelectric elements in which a lower electrode, a piezoelectric body layer, and an upper electrode are stacked may be used. Furthermore, it is also permissible to use so-called electrostatic actuators that generate static electricity between a vibration plate and an electrode so that an electrostatic force deforms a vibration plate so as to eject droplets from a nozzle, etc. Still further, a configuration that uses heating elements to produce bubbles in nozzles so that the bubbles cause ink to be ejected in the form of droplets may be provided.

The platen 4 is disposed so as to be capable of supporting the medium M in a discharge region E in which ink is ejected by the printer unit 3. That is, the printing apparatus 1 includes the platen 4 capable of supporting the medium M in the discharge region E.

The transport guiding unit 5 includes a guiding unit 500 that has a transport surface. The transport guiding unit 5 is disposed so as to be capable of supporting the medium M at a downstream side of the platen 4 in the transport direction of the medium M. In this exemplary embodiment, as illustrated in FIG. 1, the transport guiding unit 5 is provided on the transport path of the medium M between the printer unit 3 and the takeup roll medium support unit 22.

The transport guiding unit 5 further includes heaters 73 capable of heating the medium M. The heaters 73 in this exemplary embodiment are disposed on a side surface (reverse surface) of the transport guiding unit 5 opposite to the surface thereof that supports the medium M. The heaters 73 are, for example, tube heaters and are stuck to the reverse surface of the transport guiding unit 5 by an aluminum tape or the like. By driving the heaters 73, heat is conducted therefrom to heat the guiding unit 500 that supports the medium M in the transport guiding unit 5. Thus, the medium M can be heated from the reverse side of the medium M. Similarly, the platen 4 is also provided with heaters 72 that are disposed on a side surface (reverse surface) of the platen 4 opposite to the surface thereof that supports the medium M. The heaters 72 are configured in substantially the same manner as the heaters 73.

Furthermore, in this exemplary embodiment, an upstream-side guiding unit 6 capable of supporting the medium M at the upstream side of the platen 4 in the transport direction of the medium M is provided. The upstream-side guiding unit 6 is disposed on the transport path for the medium M between the feed roll medium support unit 21 and the transport roller pair 23. Similar to the transport guiding unit 5 and the platen 4, the upstream-side guiding unit 6 is provided with heaters 71 that are disposed on a surface (reverse surface) of the upstream-side guiding unit 6 opposite to a surface thereof that supports the medium M. The heaters 71 are configured in substantially the same manner as the heaters 73. The temperature of the heaters 71, 72, 73 can be appropriately set according to the medium M, the ink, and print conditions.

The tension adjustment unit 50 is capable of giving tension to the medium M. In this exemplary embodiment, the tension adjustment unit 50 is disposed so as to be able to give tension to the medium M between the transport guiding unit 5 and the takeup roll medium support unit 22. The tension adjustment unit 50 includes a pair of frame portions 54 that are spaced from each other in the width direction of the medium M and that are pivotable about a pivot shaft 53. A tension bar 55 is disposed between one-side end portions of the two frame portions 54. The dimension of the tension bar 55 in the width direction (X-axis directions) is greater than the width of the medium M. A portion of the tension bar 55 comes into contact with the medium M so as to give tension to the medium M. A weight portion 52 is disposed between other-side end portions of the two frame portions 54. Thus, by pivoting the tension adjustment unit 50 about the pivot shaft 53, the position of the tension adjustment unit 50 can be changed.

Figure 2A:
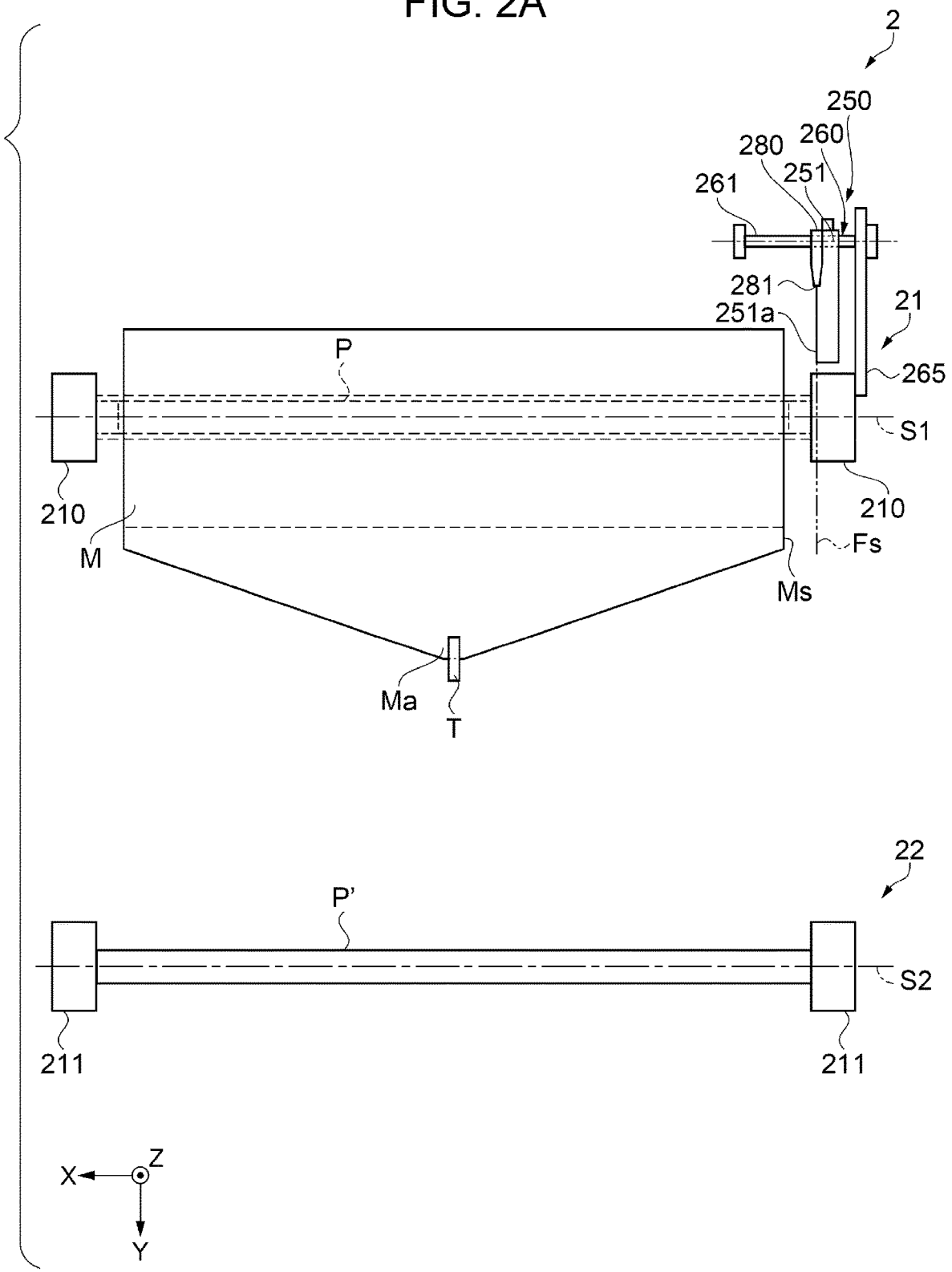
FIG. 2A is a schematic diagram illustrating a configuration of a roll medium transport apparatus according to the first exemplary embodiment.
Figure 2B:
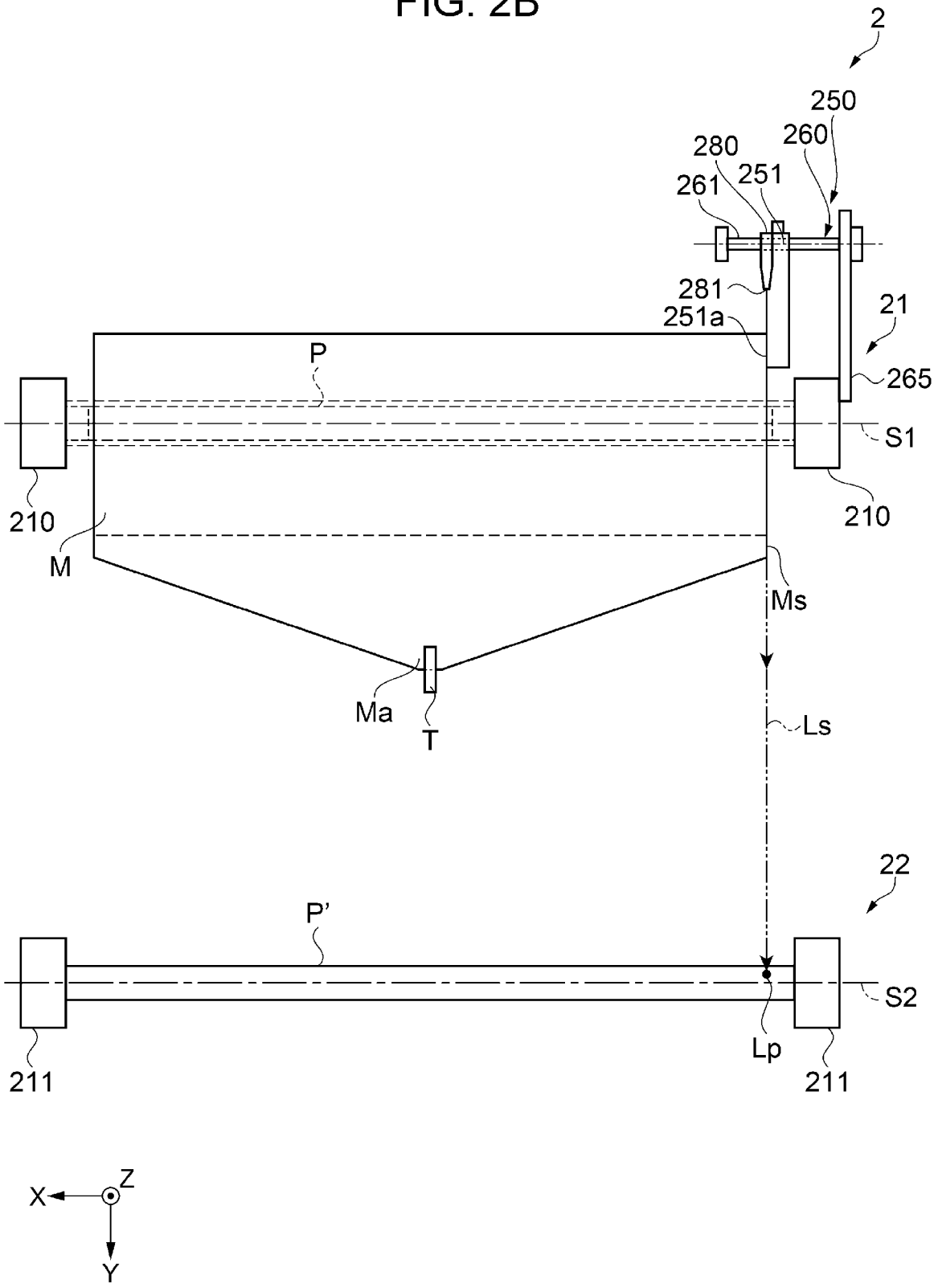
FIG. 2B is a schematic diagram illustrating a configuration of the roll medium transport apparatus according to the first exemplary embodiment.

Next, details of the configuration of the roll medium transport apparatus 2 will be described. FIGS. 2A and 2B are schematic diagrams (plan views) illustrating a configuration of the roll medium transport apparatus according to this exemplary embodiment. As illustrated in FIGS. 1, 2A and 2B, the roll medium transport apparatus 2 includes the feed roll medium support unit 21 that feeds the medium M, the takeup roll medium support unit 22 that winds up the fed medium M, a position acquiring unit 250 that acquires the position of a side end portion of the medium M fed, and a radiating unit 280 capable of radiating light, with the position of the side end portion of the medium M being used as a reference point.

The medium M is in a rolled state in which the medium M is wound on a cylindrical pipe P. The feed roll medium support unit 21 includes a pair of spindle holders 210 that hold two ends of the pipe P on which the medium M has been wound. Furthermore, the takeup roll medium support unit 22 includes two spindle holders 211 that hold two ends of a pipe P' that is a takeup roll for winding up the medium M fed from the feed roll medium support unit 21 side. An axis S1 of the spindle holders 210 of the feed roll medium support unit 21 and an axis S2 of the spindle holders 211 of the takeup roll medium support unit 22 are parallel to each other. That is, the axis S1 and the axis S2 are parallel to the X-axis directions.

The position acquiring portion 250 includes a plate portion 251 and a movement portion 260 capable of moving the plate portion 251. The movement portion 260 is supported by an adjacent one of the spindle holders 210 via a connector portion 265. The plate portion 251 has a contact surface 251*a* that contacts a side end portion Ms of the medium M. The side end portion Ms of the medium M is an end portion thereof that faces a direction intersecting the transport direction of the medium M (that faces in the width direction of the medium M). In this exemplary embodiment, the position acquiring unit 250 acquires the position of one of two side end portions Ms of the medium M. Therefore, the position acquiring unit 250 is disposed at a one-side end portion Ms side of the medium M.

The contact surface 251*a* of the plate portion 251 is a flat surface and an imaginary line Fs extending along and from the contact surface 251*a* is perpendicular to the direction of the axis S1.

The movement portion 260 is, for example, a ball screw mechanism. A screw shaft 261 of the movement portion 260 is disposed in parallel with the axis S1. The plate portion 251 is connected to the screw shaft 261. An imaginary line Fs extending along and from the contact surface 251*a* is perpendicular to the screw shaft 261 as well.

The plate portion 251 can be moved in the X-axis directions by moving the movement portion 260. Then, when the contact surface 251*a* of the plate portion 251 is brought into contact with the side end portion Ms of the rolled medium M, the contact surface 251*a* of the plate portion 251 coincides in position with the side end portion Ms of the medium M. That is, a position that serves as the reference point of the side end portion Ms of the medium M can be acquired (specifically determined).

Incidentally, the length of the screw shaft 261 of the movement portion 260 can be arbitrarily set. That is, the length of the screw shaft 261 can be set according to the width dimension of the medium M (the dimension thereof in the X-axis directions) that can be set in the roll medium transport apparatus 2.

The radiating unit 280 is capable of radiating light and, for example, is a laser light radiating apparatus capable of radiating laser light Ls. The radiating unit 280 includes a radiation opening 281 through which the laser light Ls is radiated (emitted).

Note that, as illustrated in FIG. 1, the feed roll medium support unit 21 is disposed at a higher position in the vertical direction than the takeup roll medium support unit 22. Therefore, the radiation opening 281 is disposed so as to face downward in a vertical direction toward the pipe P' of the takeup roll medium support unit 22.

Furthermore, the radiating unit 280 is mounted on the plate portion 251 of the position acquiring unit 250. More specifically, a configuration is made in which the radiation opening 281 of the radiating unit 280 is immediately over the contact surface 251*a* of the plate portion 251. Due to this configuration, the laser light Ls radiated from the radiation opening 281 is parallel to the contact surface 251*a*. Therefore, it is possible to radiate the laser light, using the contact surface 251*a* as a reference point. Furthermore, the radiating unit 280 is movable in association with movement of the plate portion 251 of the position acquiring unit 250. This eliminates the need to move the plate portion 251 and the radiating unit 280 individually and therefore allows the operating efficiency to be increased.

As illustrated in FIG. 2B, the plate portion 251 is moved by the movement portion 260 and the movement thereof is stopped at a position at which the contact surface 251*a* of the plate portion 251 comes into contact with the side end portion Ms of the medium M. At this position, the radiating unit 280 is caused to radiate the laser light Ls. Thus, it is possible to radiate the laser light Ls, using the side end portion Ms of the medium M as a reference point. Then, an upper portion of the pipe P' of the takeup roll medium support unit 22 receives the laser light Ls radiated from the radiating unit 280. That is, the position on the pipe P' of the takeup roll medium support unit 22 which corresponds to the reference point set at the position of the side end portion Ms of the medium M is visually recognized as a luminous point Lp of the laser light Ls.

Incidentally, in a configuration of the printing apparatus 1 in which there is any object or the like that blocks the laser light Ls between the radiation opening 281 of the radiating unit 280 and the pipe P' of the takeup roll medium support unit 22, this laser blocking object may be provided with a through hole such as a slit. In this manner, the laser light Ls radiated from the radiation opening 281 of the radiating unit 280 can directly irradiates the pipe P' of the takeup roll medium support unit 22.

Figure 3:
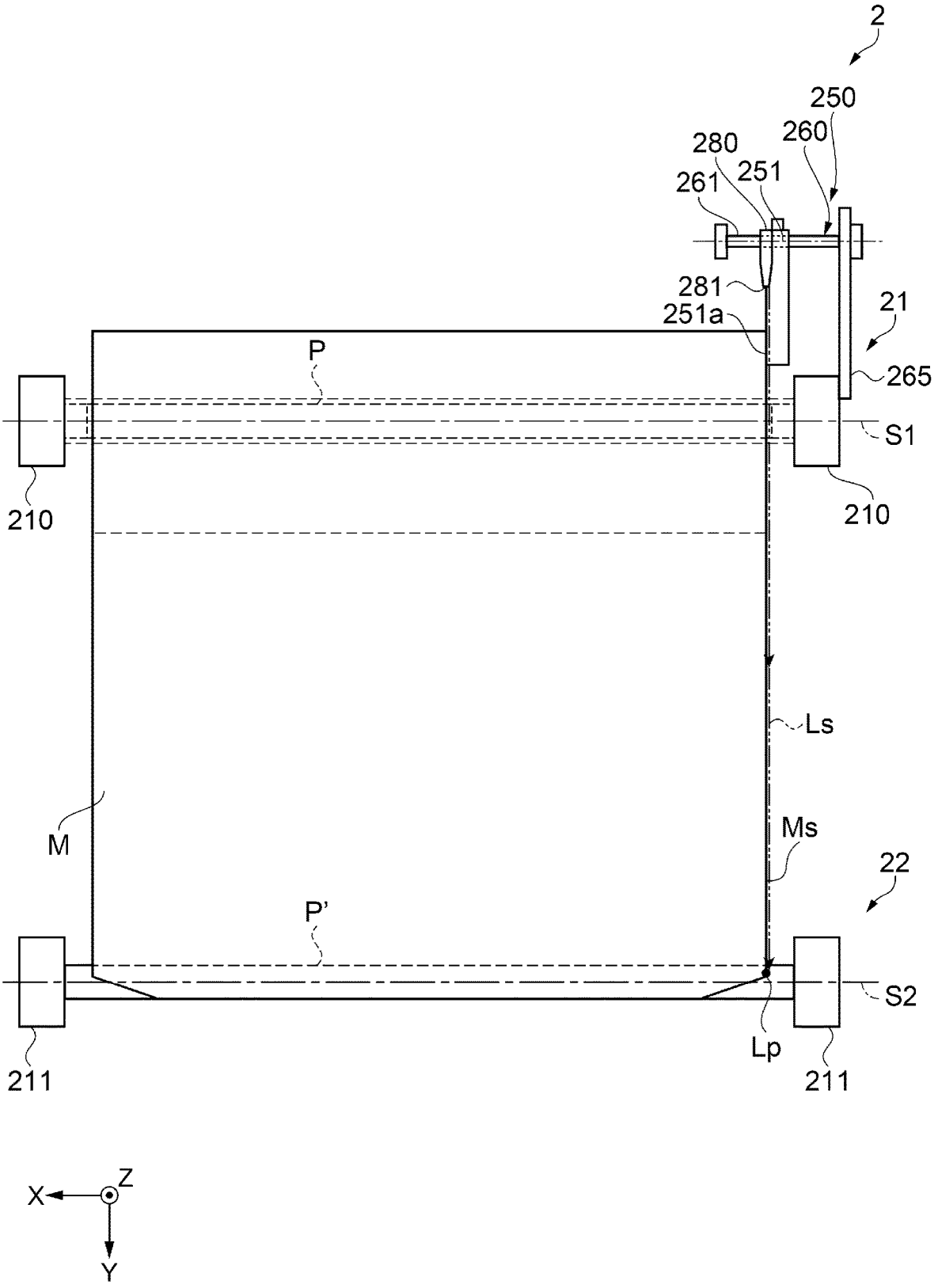
FIG. 3 is a schematic diagram illustrating a setting method for a roll medium according to the first exemplary embodiment.

Next, a setting method for a roll medium will be described. Described below will be a setting method for the medium M in the above-described printing apparatus 1 (the roll medium transport apparatus 2). FIG. 3 is a schematic diagram illustrating a setting method for a roll medium according to this exemplary embodiment. The following description will be made with reference to FIGS. 2A, 2B, and 3.

First, as illustrated in FIG. 2A, the medium M wound in a roll around the pipe P is set to the feed roll medium support unit 21. Concretely, the pipe P around which the medium M has been rolled is held at its two ends by the two spindle holders 210. Likewise, the pipe P' for winding up the medium M fed from the feed roll medium support unit 21 is set to the takeup roll medium support unit 22. Concretely, the two ends of the pipe P' are held by the two spindle holders 211.

Subsequently, as illustrated in FIG. 2B, the plate portion 251 is moved to bring the contact surface 251*a* of the plate portion 251 into contact with the side end portion Ms of the medium M. Concretely, the plate portion 251 is moved toward the medium M (in the positive direction of the X axis in this exemplary embodiment) by driving the movement portion 260 and is stopped at a position at which the contact surface 251*a* of the plate portion 251 comes into contact with the side end portion Ms of the medium M. Thus, due to the contact surface 251*a* of the plate portion 251, the reference point of the side end portion Ms of the medium M is acquired (specifically determined).

Then, as illustrated in FIG. 2B, the laser light Ls is radiated from the radiating unit 280. Specifically, the laser light Ls is radiated from the position set as the reference point of the side end portion Ms of the medium M toward the pipe P' of the takeup roll medium support unit 22. Thus, the pipe P' of the takeup roll medium support unit 22 receives the laser light Ls radiated from the radiating unit 280. A portion of the pipe P' which receives the laser light Ls becomes visible as a luminous point Lp.

Subsequently, as illustrated in FIG. 3, a distal end portion Ma of the medium M is fed (pulled out) from the feed roll medium support unit 21 and fixed to the pipe P' of the takeup roll medium support unit 22 by, for example, a sticky tape T stuck to the distal end portion Ma of the medium M, in such a manner that the side end portion Ms of a fed (pulled-out) portion of the medium M is aligned with the luminous point Lp on the pipe P' of the takeup roll medium support unit 22. Thus, the setting of the medium M is completed.

This exemplary embodiment achieves the following advantageous effects.

Since the laser light Ls radiated from the position as the reference point set on the side end portion Ms of the medium M in the feed roll medium support unit 21 strikes the pipe P' of the takeup roll medium support unit 22 and provides a marking of luminous point Lp of the laser light Ls on the pipe P', the side end portion Ms of the medium M can be set in alignment with the marking of the luminous point Lp. Therefore, the medium M can be easily set in parallel and the operation of setting the medium M can be easily carried out. Furthermore, since the feed roll medium support unit 21 is disposed above the takeup roll medium support unit 22 in terms of a vertical direction, it is easy to make an arrangement such that the laser light Ls radiated from the radiating unit 280 strikes an upper portion of the pipe P'. This, in turn, makes it easy for a user to see the luminous point Lp on the pipe P of the takeup roll medium support unit 22 at the time of setting the medium M, further improving the ease of operation.

Second Exemplary Embodiment

Figure 4:
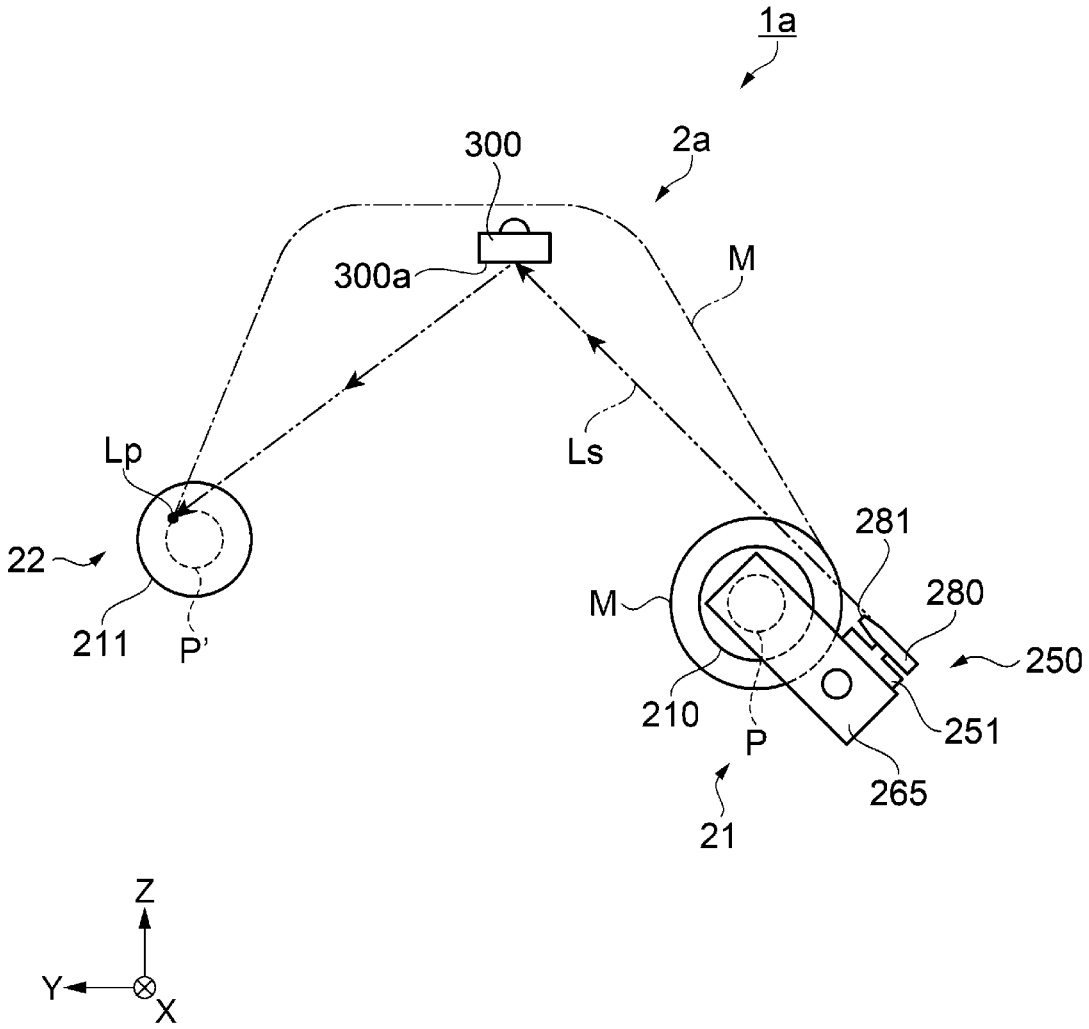
FIG. 4 is a schematic diagram illustrating a configuration of a roll medium transport apparatus according to a second exemplary embodiment of the invention.

A second exemplary embodiment will be described. FIG. 4 is a schematic diagram illustrating a configuration of a roll medium transport apparatus according to this exemplary embodiment. A basic configuration of the printing apparatus 1*a* according to this exemplary embodiment is substantially the same as that of the printing apparatus 1 according to the first exemplary embodiment and is not described below. The description given below concerns differences from the first exemplary embodiment, that is, a configuration of a roll medium transport apparatus 2*a*.

As illustrated in FIG. 4, the roll medium transport apparatus 2*a* of the printing apparatus 1*a* includes a feed roll medium support unit 21 that feeds a medium M, a takeup roll medium support unit 22 that winds up the medium M fed, a position acquiring unit 250 that acquires the position of a side end portion of the fed medium M, and a radiating unit 280 capable of radiating light with the position of the side end portion of the medium M being used as a reference point. The printing apparatus 1*a* further includes a reflector member 300 that reflects light radiated from the radiating unit 280.

Furthermore, in this exemplary embodiment, the feed roll medium support unit 21 is disposed below the takeup roll medium support unit 22 in terms of a vertical direction.

A configuration other than the reflector member 300 is substantially the same as the configuration of the printing apparatus 1 of the first exemplary embodiment and therefore will not be described below.

The reflector member 300 has a mirror surface 300*a* that reflects the laser light Ls and is disposed at a position that is above the feed roll medium support unit 21 and the takeup roll medium support unit 22 in terms of the vertical direction and that is such a position that the mirror surface 300*a* reflects the laser light Ls radiated from the radiating unit 280 and the laser light Ls reflected by the mirror surface 300*a* irradiates the pipe P' of the takeup roll medium support unit 22. Therefore, the radiation opening 281 of the radiating unit 280 is disposed toward the reflector member 300 that is disposed above the feed roll medium support unit 21 in terms of the vertical direction.

Note that it is permissible to adopt a configuration in which the reflector member 300 is rotatable and the angle of incidence of the laser light Ls radiated from the radiating unit 280 on the mirror surface 300*a* can be changed by changing the position of the mirror surface 300*a*.

Furthermore, a configuration in which a plurality of reflector member 300, instead of only one reflector member 300, are provided and used to reflect the laser light Ls may also be adopted.

Next, a setting method for a roll medium according to this exemplary embodiment will be described. Concretely, a setting method for the medium M in the printing apparatus 1*a* (the roll medium transport apparatus 2*a*) will be described.

First, the medium M wound in a roll around the pipe P is set to the feed roll medium support unit 21. Concretely, the two ends of the pipe P around which the medium M has been rolled is held by two spindle holders 210. Likewise, the pipe P' for winding up the medium M fed from the feed roll medium support unit 21 is set to the takeup roll medium support unit 22. Concretely, the two ends of the pipe P' are held by the two spindle holders 211 (see FIG. 2A).

Subsequently, the plate portion 251 is moved to bring the contact surface 251*a* of the plate portion 251 into contact with the side end portion Ms of the medium M. Concretely, the plate portion 251 is moved toward the medium M (in the positive direction of the X axis in this exemplary embodiment) by driving the movement portion 260 and is stopped at a position at which the contact surface 251*a* of the plate portion 251 comes into contact with the side end portion Ms of the medium M. Thus, due to the contact surface 251*a* of the plate portion 251, the reference point of the side end portion Ms of the medium M is acquired (specifically determined) (see FIG. 2B).

Then, as illustrated in FIG. 4, the laser light Ls is radiated from the radiating unit 280 toward the reflector member 300. Specifically, the laser light Ls is radiated from the position set as the reference point of the side end portion Ms of the medium M toward the reflector member 300. Then, the laser light Ls reflected by the reflector member 300 radiates toward the pipe P' of the takeup roll medium support unit 22. Thus, the pipe P' of the takeup roll medium support unit 22 receives the laser light Ls radiated from the radiating unit 280. A portion of the pipe P' which receives the laser light Ls becomes visible as a luminous point Lp.

Subsequently, a distal end portion Ma of the medium M is fed (pulled out) from the feed roll medium support unit 21 and fixed to the pipe P' of the takeup roll medium support unit 22 by, for example, a sticky tape stuck to the distal end portion Ma of the medium M, in such a manner that the side end portion Ms of a fed (pulled-out) portion of the medium M is aligned with the luminous point Lp on the pipe P' of the takeup roll medium support unit 22 (see FIG. 3). Thus, the setting of the medium M is completed.

Note that a light scatterer that causes the linear scattering of light reflected from the reflector member 300 when the takeup roll is irradiated may be provided. It is appropriate that the light scatterer include various lenses such as to scatter the laser light Ls radiated from the reflector member 300. Alternatively, the mirror surface 300*a* of the reflector member 300 may be rotatable so that the position of the mirror surface 300*a* can be changed to scatter (spread) the laser light Ls. In this arrangement, a linear luminous area appears on the pipe P' of the takeup roll medium support unit 22, so that the side end portion Ms of the medium M can be more easily set by aligning it with the linear luminous area.

This exemplary embodiment archives the following advantageous effects.

Even in the configuration in which the feed roll medium support unit 21 is disposed below the takeup roll medium support unit 22 in terms of the vertical direction, it is possible to make an arrangement in which the laser light Ls radiated from the radiating unit 280 irradiates the reflector member 300 that is disposed above the feed roll medium support unit 21 and the takeup roll medium support unit 22 in terms of the vertical direction and the laser light Ls reflected from the reflector member 300 strikes an upper portion of the pipe P' of the takeup roll medium support unit 22 that is disposed below the reflector member 300 in the vertical direction, so that the medium M can be easily set.

Even in a configuration in which the feed roll medium support unit 21 is disposed above the takeup roll medium support unit 22 in terms of the vertical direction, for example, if the laser light Ls radiated from the radiating unit 280 cannot be caused to directly strike an upper portion of the pipe P' of the takeup roll medium support unit 22 due to an obstacle or the like, disposal of the reflector member 300 according to the exemplary embodiment will make it possible to cause the laser light Ls to strike the pipe P' of the takeup roll medium support unit 22 bypassing the obstacle or the like.

The invention is not limited to the foregoing exemplary embodiments but can be modified or improved in various manners. Modifications of the exemplary embodiments will be described below.

Modifications

Although the exemplary embodiments are described above in conjunction with the configurations in which the roll medium transport apparatuses 2 and 2*a* are mounted in the printing apparatuses 1 and 1*a* as examples, the invention is applicable to the roll medium transport apparatuses 2 and 2*a* in a stand-alone state. For example, the invention is effective also in roll medium transport apparatuses 2 and 2*a* for re-winding the medium M wound in a roll onto a separate pipe P or P'.

Furthermore, although the radiating unit 280 described above uses laser light, the light source of the radiating unit 280 is not limited to a laser light source but any light source may be adopted provided that the light source is configured so that light emitted therefrom is made into parallel light by a lens or the like so that the light is increased in straightness so as not to spread, as in, for example, a combination of a light emitting diode (LED) light source and a collimator.

This application claims priority under 35 U.S.C. § 119 to Japanese Patent Application No. 2017-050912, filed Mar. 16 2017. The entire disclosure of Japanese Patent Application No. 2017-050912 is hereby incorporated herein by reference.

What is claimed is:

1. A roll medium transport apparatus comprising:

a feed roll medium support unit that feeds a roll medium;

a takeup roll medium support unit that winds up the roll medium that has been fed;

a position acquiring unit that acquires a position of a side end portion of the roll medium that is to be fed; and a radiating unit capable of radiating light with a position of the side end portion being used as a reference point, wherein the radiating unit is held by the feed roll medium support unit and allows the light to be radiated to a takeup roll that winds up the roll medium.

2. The roll medium transport apparatus according to claim 1, wherein the radiating unit moves in association with movement of the position acquiring unit.

3. The roll medium transport apparatus according to claim 1, wherein the feed roll medium support unit is disposed above the takeup roll medium support unit in terms of a vertical direction.

4. The roll medium transport apparatus according to claim 1, further comprising a reflector member that reflects light radiated from the radiating unit.

5. The roll medium transport apparatus according to claim 4, further comprising a light scatterer that causes light reflected from the reflector member to scatter in a linear form when the light irradiates the takeup roll of the takeup roll medium support unit.

6. A printing apparatus comprising:

a feed roll medium support unit that feeds a roll medium;

a takeup roll medium support unit that winds up the roll medium that has been fed;

a position acquiring unit that acquires a position of a side end portion of the roll medium that is to be fed; and a radiating unit capable of radiating light with a position of the side end portion being used as a reference point, wherein the takeup roll medium support unit includes a takeup roll that winds up the roll medium and the takeup roll receives light that the radiating unit radiates.

7. A setting method for a roll medium in a roll medium transport apparatus that includes a feed roll medium support unit that feeds a roll medium, a takeup roll medium support unit that winds up the roll medium that has been fed, a position acquiring unit that acquires a position of a side end portion of the roll medium that is to be fed, and a radiating unit capable of radiating light with a position of the side end portion being used as a reference point, the setting method comprising setting the roll medium in alignment with light radiated on a takeup roll of the takeup roll medium support unit.

* * * * *